US005634303A

United States Patent [19]

Ellingson

[11] Patent Number: 5,634,303

[45] Date of Patent: Jun. 3, 1997

[54] DOOR JAMB ASSEMBLY WITH EXTRUDED UNITARY BRICKMOLD AND STOP

[76] Inventor: Robert T. Ellingson, P.O. Box 2299, Covington, Ga. 30209

[21] Appl. No.: 549,056

[22] Filed: Oct. 27, 1995

[51] Int. Cl.[6] ..... E06B 1/04

[52] U.S. Cl. ..... 52/210; 52/212; 52/211; 52/204.1; 49/504; 49/505; 49/DIG. 2

[58] Field of Search ..... 52/210, 211, 204.51, 52/204.53, 204.1, 212; 49/DIG. 2, 504, 505

[56] References Cited

U.S. PATENT DOCUMENTS

| | | | |
|---|---|---|---|
| 2,736,930 | 3/1956 | Longley | 52/211 |
| 3,040,390 | 6/1962 | Carlton | 52/211 |
| 3,119,156 | 1/1964 | Salter, Jr. | 52/211 |
| 3,245,124 | 4/1966 | Foske | 52/211 |
| 3,402,520 | 9/1968 | Lee et al. | 49/DIG. 2 X |
| 3,570,202 | 3/1971 | Costellano | 52/211 X |
| 3,729,870 | 5/1973 | Kudlheim et al. | 52/211 X |
| 4,281,481 | 8/1981 | Wendt | 52/211 X |
| 4,492,063 | 1/1985 | Schock et al. | 49/DIG. 2 X |
| 4,505,080 | 3/1985 | Sailor | 52/211 |
| 4,720,951 | 1/1988 | Thorn et al. | 49/DIG. 2 X |

FOREIGN PATENT DOCUMENTS

| | | | |
|---|---|---|---|
| 1946996 | 10/1969 | Germany | 49/DIG. 2 |
| 2436055 | 12/1976 | Germany | 52/211 |
| 3442476 | 7/1985 | Germany | 52/211 |
| 2214214 | 8/1989 | United Kingdom | 52/211 |

*Primary Examiner*—Carl D. Friedman
*Assistant Examiner*—W. Glen Edwards
*Attorney, Agent, or Firm*—Isaf, Vaughan & Kerr

[57] ABSTRACT

An improved door jamb and brickmold assembly has a rectangular wooden jamb and a unitary co-extruded thermoplastic member mounted to said jamb and defining both the door stop and the brickmold of the assembly. In one embodiment, an elongated securing tab projects from the brickmold and is positioned to overly the exterior surface of a building in which the assembly is mounted for securing the brickmold to the building.

13 Claims, 1 Drawing Sheet

DOOR JAMB ASSEMBLY WITH EXTRUDED UNITARY BRICKMOLD AND STOP

FIELD OF THE INVENTION

This invention relates generally to door or window jamb assemblies used to frame openings in the walls of buildings for receiving doors and windows. More specifically, the invention relates to an improved door jamb and brickmold assembly having a wooden or plastic jamb and a unitary extruded thermoplastic brickmold and stop.

BACKGROUND OF THE INVENTION

In constructing a building such as a house, it is common that openings for receiving doors and windows are first roughly framed in with wall studs, which are usually made of wood. Subsequently, the rough framed openings are finished with a wooden door or window jamb assembly, which often is milled with an integral brickmold that abuts the brick or siding on the outside of the building. In door jamb assemblies in particular, a peripheral lip or stop usually is milled into the wood of the jamb extending around the inner periphery thereof. In use, a closed door mounted to the jamb assembly rests against the stop. In many instances, the stop bears a weather strip that bears against the closed door to seal against drafts.

The traditional method of fabricating a door jamb and brickmold assembly is to mill the peripheral frame members of the assembly from larger pieces of a high quality clear wood. In this process, a relatively thick wide piece of wood is passed through a milling machine and unwanted portions are cut or milled away and discarded as sawdust. Obviously, this process is wasteful, and is becoming more and more expensive in light of the ever increasing costs of lumber. In some instances, the entire cross section of each frame member, including the brickmold, is milled as a unitary piece from a wide thick piece of lumber. In other instances, the frame members are milled in two pieces that fit together to define the finished shape. The inner peripheral frame members may also be milled from relatively thin pieces of wood to define the door stop and the brickmold may be fixed along the outer edges of the inner frame members to define the finished shape. In either case, significant amounts of expensive lumber is required as is time consuming, expensive, and wasteful machining steps. All of this adds to the final cost of traditional door jamb and brickmold assemblies.

Door and window jamb assemblies have been developed that are wholly or partially comprised of extruded thermoplastic portions. For example, U.S. Pat. No. 4,030,830 to Sailor teaches a jamb for mounting a window or door in an opening of an existing structure. The jamb includes an extruded plastic or metal outer frame comprising the stop, a wooden inner frame, or jamb, for support of the extruded outer frame, fasteners for attaching the outer frame at the window or door opening, and a molded cover that secures to the outer frame and conceals the fasteners attaching the frame to the structure. In Sailor, the portion of the plastic outer frame forming the stop and the brickmold are hollow and thus may not provide sufficient strength to the frame. The hollow nature of the brickmold makes it unsuitable for receiving standard nails that hold the assembly to the framing. Non-carpentry standard fastening means are thus employed, which is distasteful to carpenters. In addition, this jamb assembly requires the use of an auxiliary cover to conceal the fasteners attaching the frame to the building structure.

U.S. Pat. No. 5,058,323 to Gerritsen teaches a jamb cladding and brickmold assembly that provides a plastic member that either wraps around a wooden jamb with stop or that wraps around a wooden jamb and provides its own plastic stop. An attachable brickmold is also included. This assembly, like that taught by Sailor, has hollow portions unsuitable for holding nails and liable to be punctured or otherwise deformed by heavy use or forcible contact. U.S. Pat. No. 5,182,880 to Berge, Jr. et al., teaches a cladding and brickmold apparatus similar to that taught by Gerritsen in that it wraps around a combination wooden jamb and stop. Thus, this device requires the use of a wooden jamb with stop and requires that the wood be milled to form the stop, an expensive, time consuming and detailed operation. The prior art does not teach a unitary stop and brickmold assembly made of solid thermoplastic material.

SUMMARY OF THE INVENTION

Briefly described, the present invention, in a preferred embodiment thereof, comprises a door jamb and brickmold assembly having a flat peripheral inner frame and a stop and brickmold formed from a unitary extruded thermoplastic material. In the preferred embodiment, the peripheral inner frame is formed from relatively thin flat wooden boards to provide a traditional looking surface and to provide a solid material for receiving nails and screws when mounting the jamb and when hanging a door from the jamb. The stop and brickmold is extruded from appropriate thermoplastic material to have a cross sectional configuration that forms both the stop of the jamb assembly and the brickmold that frames the assembly on the outside of a building structure. The extruded stop and brickmold is adhered or otherwise firmly mounted to the frame member so that together they form a traditional looking door jamb and brickmold assembly.

The brickmold and stop is extruded from a thermoplastic extruder and preferably has a relatively less dense blown core covered by a relatively more dense plastic outer skin or covering. The density of the blown core is sufficient to receive and hold a traditional finish nail so that the assembly can be nailed in place through the brickmold in the traditional way. In one embodiment, the brickmold is coextruded with a relatively hard plastic flange or tab that projects outwardly from the assembly and that is positioned to overlie the outside surface of the building. During installation, the assembly is positioned with the flange against the outer wall of the building and the assembly and flange are fastened with nails or screws. Brick, lap board, or another exterior finish can then be applied over the flange abutting the brickmold to result in a traditional looking exterior door molding arrangement. In the preferred embodiment, the extrusion is also formed to define a groove or slot that extends along the stop of the assembly for receiving and holding the mounting tab of a length of weather stripping.

Thus it is seen that an improved door jamb assembly is now provided wherein the need to mill or otherwise machine the wooden portions of the jamb is eliminated. A relatively inexpensive thin flat board is used to form the inner peripheral jamb. Both the stop and decorative brickmold of the assembly are formed from a unitary thermoplastic coextrusion that looks, feels, and holds nails like wood but that is substantially less expensive than wood. Additional advantages are that the thermoplastic does not rot, does not deteriorate, and is not subject to infestation by vermin. Finally, the jamb assembly of this invention can be installed with finish nails in the same way as a traditional wooden assembly. This is an advantage to carpenters, who prefer traditional installation methods to new or complex alternate methods. These and many other objects, features, and advantages will become more apparent upon review of the detailed description set forth below taken in conjunction with the accompanying drawings, which are briefly described as follows.

DETAILED DESCRIPTION OF THE PREFERRED EMBODIMENTS

Figure 1:
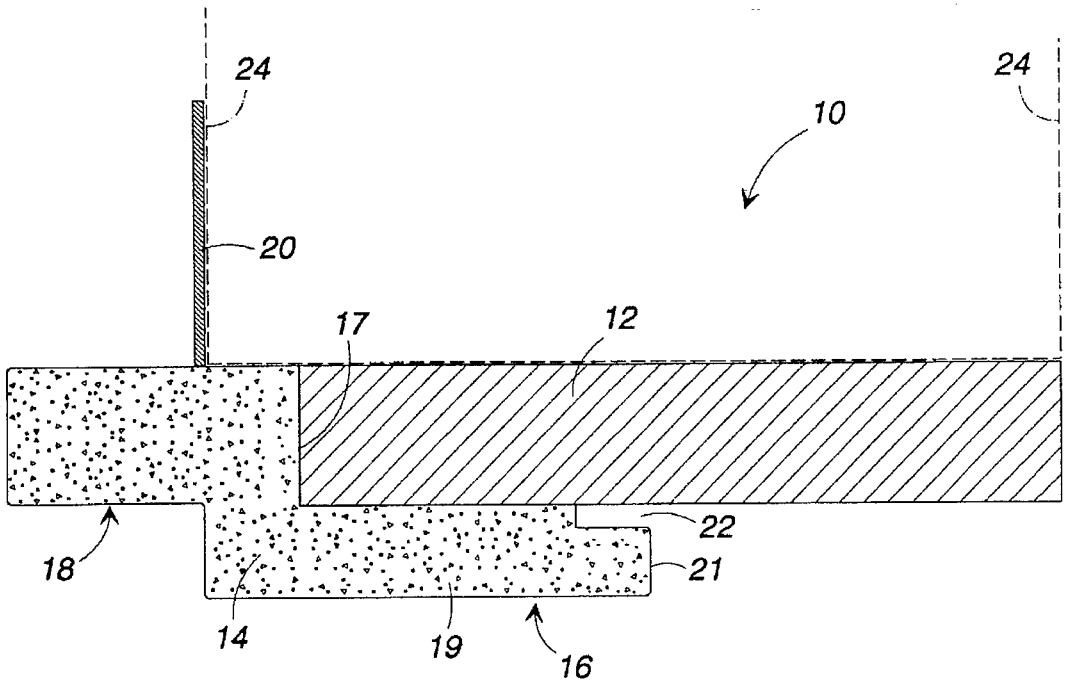
FIG. 1 is a cross-sectional view of a door jamb and brickmold assembly that embodies principles of the present invention in a preferred form.

FIG. 1 is a cross-sectional view of a door jamb and brickmold assembly that embodies principals of this invention in a preferred form. It will be understood that the complete assembly comprises three sections fabricated as shown in FIG. 1 that frame a doorway opening on the sides and top. The portion of the assembly on the right in FIG. 1 resides on the interior of a building in which the assembly is installed and the portion on the left, known as the brickmold, resides on the outside of the building.

The door jamb and brickmold assembly 10 comprises a jamb member 12 in the form of an elongated relatively thin rectangular board. In the preferred embodiment, the jamb member 12 is made of a flat wooden board. Such construction provide a traditional appearance on the inside of the building structure and also provides for traditional fastening of the jamb and brickmold assembly to a framed-in opening with nails or screws. However, material other than wood could be used for the jamb member with comparable results. The use of wood for the jamb member 12 is not disadvantageous as is the milled wooden door jambs of the prior art. This is because the jamb member in this invention is a simple flat board that does not require any special and expensive machining or milling and that is readily available at reasonable cost and in standard sizes.

A unitary brickmold and stop member 14 is securely fixed with adhesive or other appropriate means along the outer side portion of the jamb member 12. The brickmold and stop member 14 is formed of a suitable thermoplastic material that has been coextruded through a plastic extruder head to have the exterior shape and configuration shown in FIG. 1. Preferably, the coextrusion that forms the member 14 is substantially solid with the interior portion thereof being extruded of a relatively less dense blown thermoplastic material and with the exterior skin being a relatively more dense unblown thermoplastic material. The interior thermoplastic material is extruded with a blowing agent with proper characteristics to result in a density and consistency sufficient to receive and hold a traditional finishing nail or the like. The exterior skin of the member 14 provides a resilient surface that is resistant to impacts while at the same time providing an excellent surface for receiving primers and paints. Blowing and extruding techniques are well known and any suitable technique and combination of materials may be used in the present invention.

The brickmold and stop member 14 is formed to define a rabbet 17 that is shaped and sized to receive the end of the jamb member 12 as shown. The rabbet 17 defines a leg 19 of the member 14 that is mounted to the surface of the jamb member 12 and extends to approximately the mid portion thereof. The leg 19 terminates in an end portion 21 that extends outwardly from and perpendicular to the surface of the jamb member 12. With this configuration, the end portion 21 of the leg 19 forms a peripheral stop that extends around the interior of the jamb assembly. In use, a door mounted to the jamb assembly, when closed, rests against the stop as it would against the milled stop of a prior art all wooden jamb assembly. Preferably, the end portion of the leg 19 is also formed with a narrower rabbet 22 that, in conjunction with the surface of the jamb member 12, forms a groove or slot that extends around the jamb member at the intersection of the stop and the jamb. The groove formed by the rabbet 22 is sized and shaped to receive the mounting tab of a length of traditional weather stripping material that seals against a closed door resting against the stop 21. Thus, the mounting tab of the weather strip is both concealed and secured firmly to the assembly in the groove formed by the rabbet 22.

The other end of the member 14 is shaped to define a decorative brickmold section 18 of the member. The brickmold section 18 is sized and shaped to extend outwardly from the outer edge of the jamb so that it frames the entire door and jamb assembly on the outside of the building to which the assembly is attached. An elongated flap or tab 20 is coextruded with and is an integral part of the brickmold and stop member 14. The tab 20 projects rearwardly of the member 14 and is formed of a relatively dense rigid plastic material that is adapted to receive and hold nails and screws. The purpose of the tab 20 is to allow the assembly to be mounted to the framing of a building, indicated by the numeral 24, with the tab 20 being secured by nails or screws to the framing around the exterior of the opening. If desired, a sealant can be applied between the tab 20 and the framing of the building to provide an airtight seal against drafts that might otherwise enter the building between the jamb assembly and the frame. The tab 20 also serves to hold the brickmold and stop member 14 securely in place around the entire periphery of the opening. Once the assembly is installed with the tab securely fixed, the tab 20 is covered with brick, siding, or other facade as selected by the builder. Such facade abuts against the back edge of the brickmold portion 18 and, in the case of brick, can even extend forwardly of this portion. Thus, the appearance of a traditional milled wooden brickmold is presented.

The door jamb and brickmold assembly illustrated in FIG. 1 is substantially more economical to produce than traditional all wood milled jamb assemblies. In addition, it is far superior to prior art assemblies that attempt to combine extruded plastic portions with wooden portions wherein the plastic portions are hollow or otherwise insufficient to receive and hold traditional fastening means such as nails and screws. Further, an environmental advantage is provided by this invention in that a single flat board is used for the jamb member 12. This eliminates the need to start with a much thicker and wider board and mill it down in a wasteful process of forming a milled wooden jamb assembly. Accordingly, much less wood is used and wasted, which contributes to conservation of the environment. Finally, the coextruded brickmold and stop member 14 is rugged, strong, able to receive and hold a nail, and provides all of the advantages of wood with the additional advantage that it is not subject to rot and vermin and has a surface particularly suited to application of primer and paint.

Figure 2:
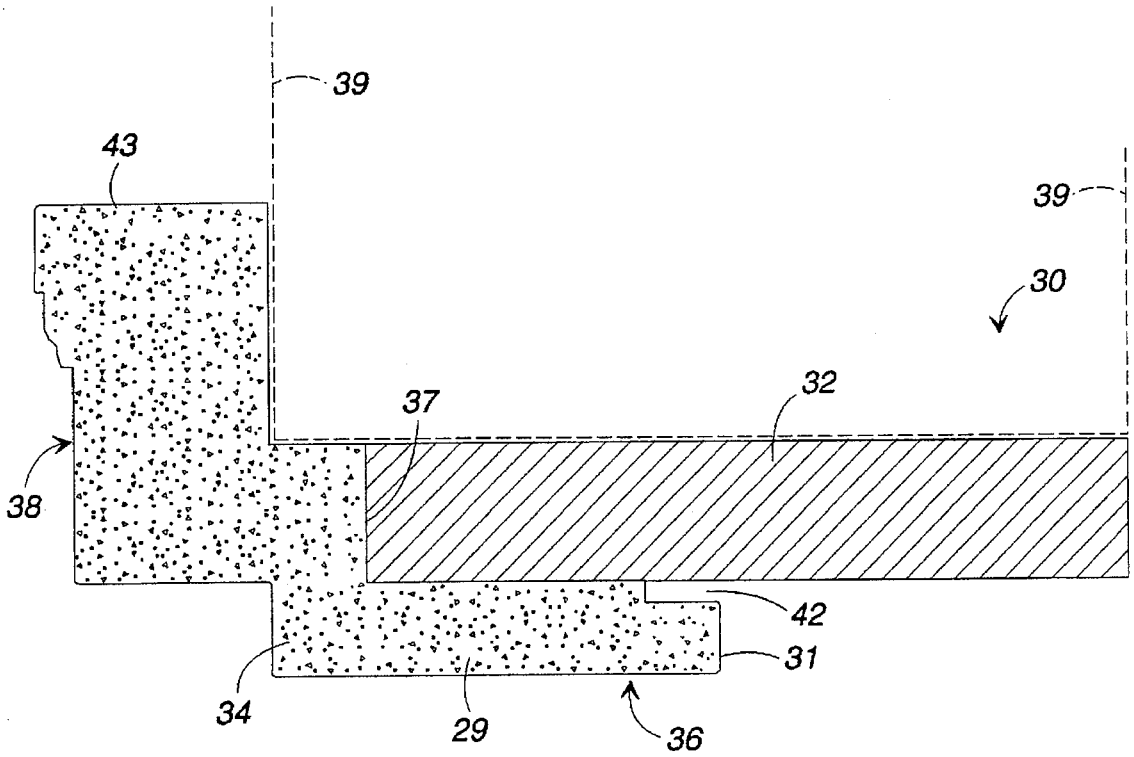
FIG. 2 is a cross-sectional view of a door jamb and brickmold assembly that embodies principles of the present invention in an alternate form.

FIG. 2 illustrates an alternate embodiment of this invention having a second type of decorative brickmold formed by the coextruded thermoplastic member. In this embodiment, as in the embodiment of FIG. 1, a rectangular relatively thin wooden jamb member 32 has attached thereto by adhesive or other suitable means a coextruded thermoplastic brickmold and stop member 34. The brickmold and stop member 34 is formed with a rabbet 37 that receives the end portion of the jamb member 32. The end portion 31 of the leg 29 forms a stop for a closed door. Similarly, a small narrow rabbet 42 forms a groove for receiving and holding the mounting tab of a length of weather stripping.

In the embodiment of FIG. 2, the securing tab 20 of FIG. 1 is eliminated and replaced by a decorative brickmold portion that extends rearwardly from the jamb assembly and overlies the exterior framing of a building in which the assembly is installed. Since the coextruded brickmold and stop member 34 is formed with a relatively less dense blown core and a relatively more dense outer skin, it is uniquely suited to receive and hold a common finishing nail. Accordingly, such a nail can be driven directly through the brickmold portion 38 of the member 34 to secure the front of the jamb in place to a framing stud 39. The embodiment of FIG. 2 more closely parallels one traditional decorative design for door jamb and brickmold assemblies. As with the embodiment of FIG. 1, brick, siding, or other facade is secured to the exterior of the building after the jamb has been installed and the facade butts against the end 43 of the brickmold portion 38 in the traditional way.

The invention has been described herein in terms of preferred embodiments and methodologies. It will be clear to those of skill in the art, however, that various modifications might be made to the illustrated embodiments within the scope of the invention. For example, the particular decorative shape of the brickmold portion of the extruded member could be made to simulate virtually any decorative trim. The assembly could be made with or without a groove for receiving a length of weatherstripping if desired. In the illustrated embodiment, the jamb members are preferably made of wood to provide certain advantages inherent in wooden products. However, this portion could also be made of an extruded plastic or other suitable material. Indeed, it might be possible to extrude the entire structure from a single monolithic piece of thermoplastic material. Further, the assembly of this invention could also, with only slight modification, be adapted to use as a window jamb assembly. In such an embodiment, the raised stop formed by the brickmold and stop member would be positioned and shaped to engage the sashes and Gash guides of the window rather than a closed door. Accordingly, it should be understood that the words "stop" and "closed door" when used in the specification and claims hereof should be interpreted to include a stop positioned and configured to engage the sashes of a window as well as a closed door. These and other modifications, additions, and deletions might well be made by those of skill in the art without departing from the spirit and scope of the invention as set forth in the claims.

I claim:

1. a two piece door jamb and brickmold assembly for installation in an opening formed in a wall of a building structure to receive and support a hinged door, said door jamb and brickmold assembly comprising:

an elongated jamb member having an inside edge portion, an outside edge portion, and a face;

a substantially solid one piece brickmold and stop member mounted to said jamb member extending along the outside edge portion thereof;

said brickmold and stop member being contoured to define a leg that overlies a portion of said face of said jamb member and that forms a raised stop relative to said face of said jamb member, said stop extending along the length of said jamb member intermediate said inside and outside edge portions thereof, said stop for engaging an edge of a closed door mounted to said jamb and brickmold assembly;

said brickmold and stop member further defining a decorative brickmold that extends along the length of said jamb member adjacent to said outside edge thereof for framing said door jamb and brickmold assembly on the outside of a building structure in shich said assembly is installed.

2. A door jamb and brickmold assembly as claimed in claim 1 and wherein said brickmold and stop member is formed of an extruded thermoplastic material.

3. A door jamb and brickmold assembly as claimed in claim 2 and wherein said brickmold and stop member is coextruded with a relatively less dense blown thermoplastic core and a relatively more dense thermoplastic skin, the density and composition of said blown thermoplastic core being predetermined to receive and hold a standard construction fastener.

4. A door jamb and brickmold assembly as claimed in claim 1 and further comprising an elongated tab extending outwardly from said decorative brickmold with said tab being positioned and sized to extend over and rest against the outside of a building structure in which said door jamb and brickmold assembly is installed, said tab for securing said jamb and brickmold assembly to the building structure.

5. A door jamb and brickmold assembly as claimed in claim 4 and wherein said tab is co-extruded with said brickmold and stop member and is formed of a thermoplastic material.

6. A door jamb and brickmold assembly as claimed in claim 1 and wherein said brickmold and stop member is further formed with a rabbet adjacent to the surface of said jamb member extending along said raised stop, said rabbet for receiving the mounting tab of a length of weather stripping for sealing against a closed door secured within said door jamb and brickmold assembly.

7. A jamb and brickmold assembly comprising an elongated jamb member having an inner face and a substantially solid extruded thermoplastic brickmold and stop member mounted to said jamb member and extending therealong, said brickmold and stop member having a leg that overlies a portion of said inner face of said jamb member and that forms a riased stop extending along said inner face of said jamb member for abutting a door or window unit mounted in said jamb and brickmold assembly, said brickmold and stop member further defining a decorative brickmold for extending along said door jamb and briskmold assembly on the outside of a building in which said assembly is installed.

8. A jamb and brickmold assembly as claimed in claim 7 and wherein said brickmold and stop member is coextruded to have a relatively less dense blown thermoplastic core and a relatively more dense thermoplastic skin.

9. A jamb and brickmold assembly as claimed in claim 7 and further comprising an elongated tab extending along and projecting from said brickmold and stop assembly with said tab being positioned to lay against the outside wall of a building structure in which said assembly is installed, said tab for securing said assembly to said structure and sealing against draft.

10. A jamb and brickmold assembly as claimed in claim 7 and wherein said jamb member is made of wood.

11. A jamb and brickmold assembly as claimed in claim 10 and wherein said jamb member has a substantially rectangular cross-section.

12. In a door jamb and brickmold assembly having a jamb with an inner face, a stop, and a brickmold, the improvement comprising a unitary substantially solid coextruded thermoplastic member mounted to the jamb partially overlying said face of said jamb and defining both the stop and the brickmold of the door jamb assembly.

13. A jamb and brickmold assembly for installation in an opening of a building structure to frame and hold a door or window panel mounted therein, said jamb and brickmold assembly comprising an elongated jamb member having an inner face and a substantially solid extruded thermoplastic brickmold and stop member mounted to said jamb member, said brickmold and stop member at least partially overlying said face of said jamb and defining a raised lip positioned to provide a stop for the panel mounted in said assembly.

* * * * *